US008914976B2

(12) United States Patent
Campbell et al.

(10) Patent No.: US 8,914,976 B2
(45) Date of Patent: Dec. 23, 2014

(54) TURBINE AIRFOIL TO SHROUD ATTACHMENT METHOD

(75) Inventors: Christian X. Campbell, Oviedo, FL (US); Anand A. Kulkarni, Oviedo, FL (US); Allister W. James, Chuluota, FL (US); Brian J. Wessell, Orlando, FL (US); Paul J. Gear, Longwood, FL (US)

(73) Assignee: Siemens Energy, Inc., Orlando, FL (US)

( * ) Notice: Subject to any disclaimer, the term of this patent is extended or adjusted under 35 U.S.C. 154(b) by 745 days.

(21) Appl. No.: 13/195,959

(22) Filed: Aug. 2, 2011

(65) Prior Publication Data

US 2011/0297344 A1 Dec. 8, 2011

Related U.S. Application Data

(63) Continuation-in-part of application No. 12/752,460, filed on Apr. 1, 2010, now Pat. No. 8,714,920.

(51) Int. Cl.

| | |
|---|---|
| ***B21K 25/00*** | (2006.01) |
| ***B22D 19/00*** | (2006.01) |
| ***F01D 9/04*** | (2006.01) |
| ***F01D 11/00*** | (2006.01) |

(52) U.S. Cl.

CPC ..... *F01D 9/044* (2013.01); *B22D 19/00* (2013.01); *B22D 19/0081* (2013.01); *F01D 11/005* (2013.01); *F05B 2230/21* (2013.01); *F05B 2240/80* (2013.01)

USPC ..... 29/889.21; 29/423; 29/428; 29/527.2; 29/527.3; 164/91; 164/112

(58) Field of Classification Search

CPC ..... B23P 15/006; B21C 23/22; B22D 19/00; B22D 19/0081; F01D 11/005; F01D 9/044; F05B 2240/80; F05B 2230/21; F05B 5/00; F05B 5/12; F05B 5/141; F05B 9/00; F05B 9/042; F05B 5/3038; F05B 5/30; F05B 25/28; F05B 25/30; F05B 25/246; F05B 20/24; F05B 29/24; F05B 29/245; F05B 29/263; F05B 9/023; F05B 9/04; F05B 9/044; F05B 9/06; F05B 25/005; F05B 25/12

USPC ..... 29/889.21, 889.22, 889.2, 889, 418, 29/423, 424, 458, 469, 527.1, 527.2, 29/527.3, 527.5; 164/98, 91, 100, 112; 415/134, 137, 138, 139, 191, 185, 189, 415/200, 208.1, 208.2, 209.2, 209.3, 210.1; 416/179, 180, 204 R, 214 R, 219 R, 416/220 R, 221

See application file for complete search history.

(56) References Cited

U.S. PATENT DOCUMENTS

| | | | |
|---|---|---|---|
| 3,669,177 | A | 6/1972 | Ingalls et al. |
| 3,732,031 | A | 5/1973 | Bowling et al. |

(Continued)

*Primary Examiner* — Sarang Afzali

(57) ABSTRACT

Bi-casting a platform (50) onto an end portion (42) of a turbine airfoil (31) after forming a coating of a fugitive material (56) on the end portion. After bi-casting the platform, the coating is dissolved and removed to relieve differential thermal shrinkage stress between the airfoil and platform. The thickness of the coating is varied around the end portion in proportion to varying amounts of local differential process shrinkage. The coating may be sprayed (76A, 76B) onto the end portion in opposite directions parallel to a chord line (41) of the airfoil or parallel to a mid-platform length (80) of the platform to form respective layers tapering in thickness from the leading (32) and trailing (34) edges along the suction side (36) of the airfoil.

17 Claims, 6 Drawing Sheets

(56) References Cited

U.S. PATENT DOCUMENTS

| | | | | | |
|---|---|---|---|---|---|
| 3,878,880 | A | | 4/1975 | Jones | |
| 4,008,052 | A | | 2/1977 | Vishnevsky et al. | |
| 4,195,683 | A | | 4/1980 | Blazek | |
| 4,417,854 | A | * | 11/1983 | Cain et al. | 416/241 B |
| 4,489,469 | A | | 12/1984 | Hall | |
| 4,494,287 | A | | 1/1985 | Cruzen et al. | |
| 4,538,331 | A | | 9/1985 | Egan et al. | |
| 4,592,120 | A | | 6/1986 | Egan et al. | |
| 4,728,258 | A | | 3/1988 | Blazek et al. | |
| 4,869,645 | A | | 9/1989 | Verpoort | |
| 4,955,423 | A | | 9/1990 | Blazek | |
| 4,961,459 | A | | 10/1990 | Blazek | |
| 4,987,944 | A | | 1/1991 | Parks | |
| 5,069,265 | A | | 12/1991 | Blazek | |
| 5,181,550 | A | | 1/1993 | Blazek et al. | |
| 5,241,737 | A | | 9/1993 | Colvin | |
| 5,241,738 | A | | 9/1993 | Colvin | |
| 5,263,530 | A | | 11/1993 | Colvin | |
| 5,290,143 | A | * | 3/1994 | Kington et al. | 415/191 |
| 5,332,022 | A | | 7/1994 | Colvin | |
| 5,332,360 | A | | 7/1994 | Correia et al. | |
| 5,377,742 | A | | 1/1995 | Jarry | |
| 5,573,682 | A | | 11/1996 | Beason, Jr. et al. | |
| 5,678,298 | A | | 10/1997 | Colvin et al. | |
| 5,797,725 | A | | 8/1998 | Rhodes | |
| 5,981,083 | A | | 11/1999 | Colvin et al. | |
| 6,409,473 | B1 | | 6/2002 | Chen et al. | |
| 6,648,597 | B1 | * | 11/2003 | Widrig et al. | 415/200 |
| 7,045,220 | B2 | | 5/2006 | Ishiduka et al. | |
| 7,284,590 | B2 | | 10/2007 | Liimatainen | |
| 2006/0239825 | A1 | | 10/2006 | Rice et al. | |
| 2009/0196761 | A1 | * | 8/2009 | James | 416/241 R |
| 2011/0243724 | A1 | | 10/2011 | Campbell et al. | |

* cited by examiner

TURBINE AIRFOIL TO SHROUD ATTACHMENT METHOD

CROSS-REFERENCE TO RELATED APPLICATIONS

This application is a continuation-in-part of U.S. application Ser. No. 12/752,460 filed 1 Apr. 2010 now U.S. Pat. No. 8,714,920 and claims the benefit of the filing date thereof.

STATEMENT REGARDING FEDERALLY SPONSORED DEVELOPMENT

Development for this invention was supported in part by Contract No. DE-FC26-05NT42644 awarded by the United States Department of Energy. Accordingly, the United States Government may have certain rights in this invention.

FIELD OF THE INVENTION

This invention relates to mechanisms and methods for attachment of turbine airfoils to shroud platforms, and particularly to bi-casting of shroud platforms onto turbine airfoils.

BACKGROUND OF THE INVENTION

Bi-casting is a two-step process whereby one section of a component is cast, and then a second section is cast onto the first section in a second casting operation. Bi-casting has been utilized in gas turbine engine fabrication of vane rings and blades. Complex shapes can be designed for bi-casting that would exceed limits of castability in a single casting, and each section can have specialized material properties. Costly materials and processes such as single crystals can be selectively used where needed, reducing total cost.

A vane ring is a circular array of radially oriented stationary vane airfoils mounted between radially inner and outer shroud rings. The vane airfoils may be cast first, and then placed in a mold in which the inner and outer shroud rings are bi-cast onto the inner and outer ends of the airfoils respectively. The vane rings may be fabricated in segments. One or multiple vanes may be cast into an inner and/or an outer shroud segment to form a vane ring segment. A shroud segment on an end of a vane is called a platform.

A metallurgical bond may not form between the vane airfoils and the platforms. An oxide layer develops on the surface of the airfoil that prevents the molten metal of the platform from bonding to it. This may be overcome in order to form a bond. However, interlocking geometry without bonding has been used in the vane/platform interface to form a mechanical interconnection only.

In large gas turbines, differential thermal expansion (DTE) creates stresses between the vanes airfoils and shrouds. Providing clearance to accommodate DTE can result in lack of connection stability, stress concentrations, hot gas ingestion, and leakage of cooling air into the working gas flow from plenums and channels in the shrouds and vanes.

BRIEF DESCRIPTION OF THE DRAWINGS

The invention is explained in the following description in view of the drawings that show.

DETAILED DESCRIPTION OF THE INVENTION

The present invention provides a joint between a vane and a bi-cast platform that accommodates differential thermal expansion while maximizing connection stability and minimizing stress concentrations and coolant leakage.

Figure 1:
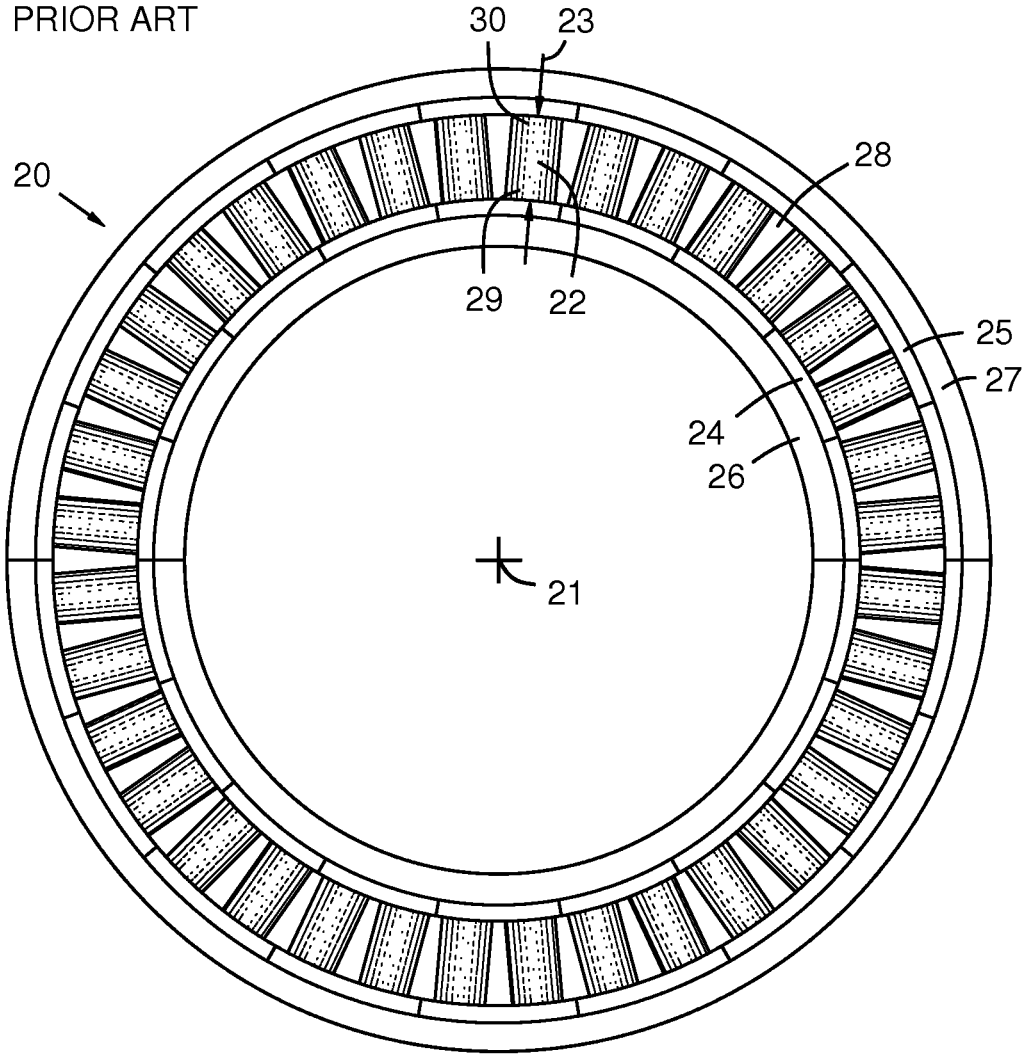
FIG 1 PRIOR ART
FIG. 1 schematically illustrates a prior art ring of vanes centered on an axis.

FIG. 1 illustrates a prior art ring 20 of stationary vanes 22 centered on an axis 21 in a turbine. Each vane 22 is an airfoil with first and second ends 29, 30. The vane spans radially 23 between inner and outer shroud segments or platforms 24, 25. Herein "radially" means perpendicular to the axis 21. The platforms 24, 25 may be attached to respective inner and outer ring structures 26, 27, which may be support rings and/or cooling air plenum structures. Between each pair of vanes 22 is a working gas flow passage 28. In a gas turbine, the vanes 22 direct a combustion gas flow against an adjacent downstream ring of rotating blades not shown. Individual vane segments are traditionally cast with one or more airfoils per pair of inner/outer platforms 24, 25 to form what is sometimes called a nozzle. For large industrial gas turbine vanes, easily cast alloys (e.g. the cobalt based alloy ECY-768) may be cast with two or three airfoils per vane segment, while alloys that are more difficult to cast (e.g. nickel based superalloys such as IN939 and CM247LC) are limited to single airfoil vane segments.

Figure 2:
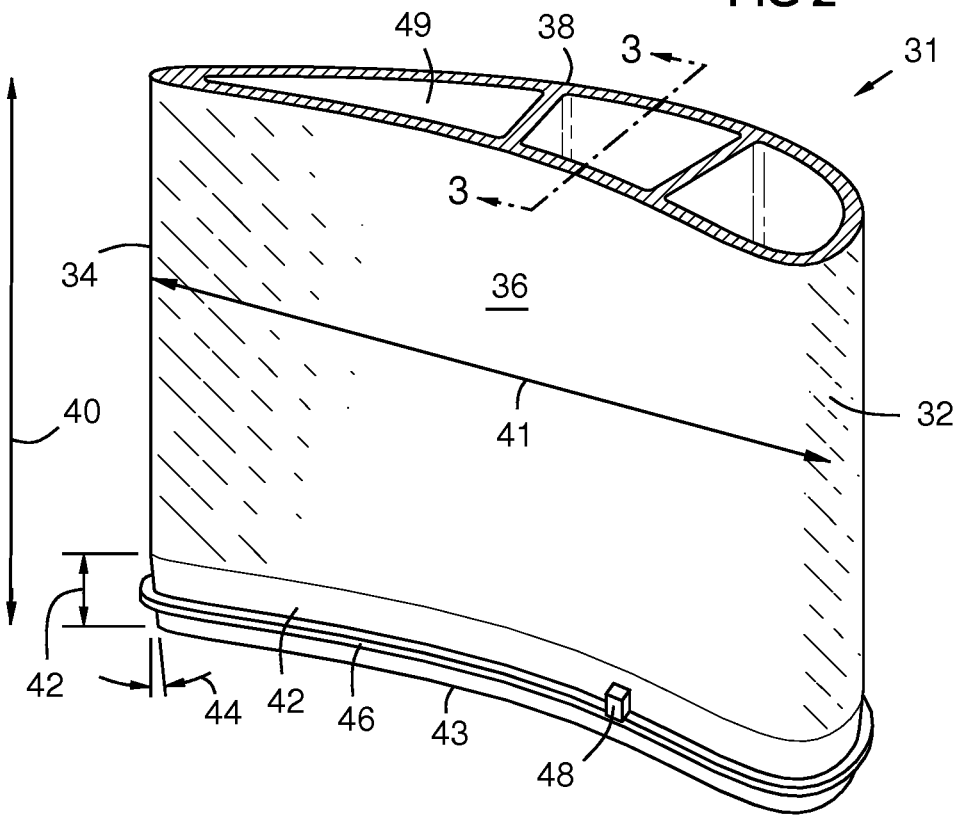
FIG. 2 is a partial perspective view of a vane airfoil according to aspects of the invention.
Figure 3:
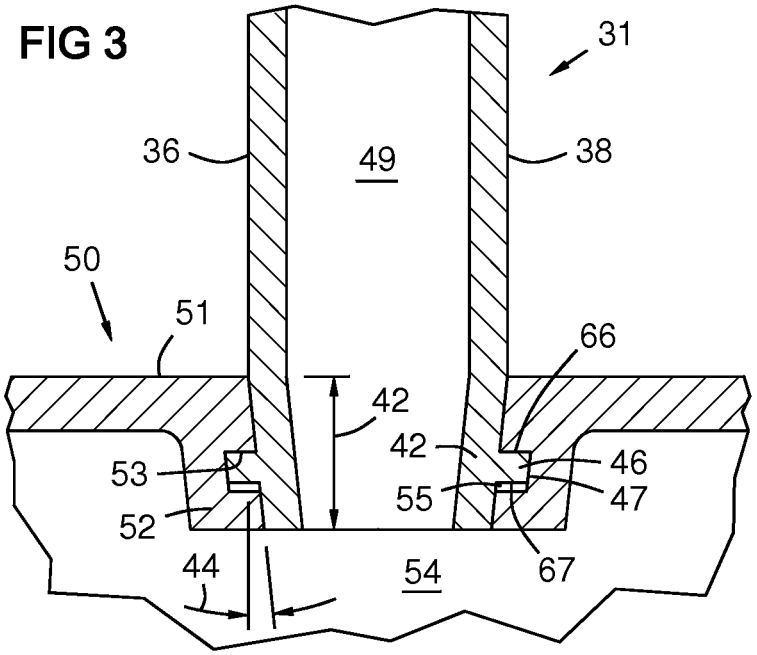
FIG. 3 is a sectional view taken along line 3-3 of FIG. 2 including a partial shroud platform.

FIGS. 2 and 3 show a portion of a turbine airfoil 31 according to an embodiment of the invention. It has leading and trailing edges 32, 34, pressure and suction sides 36, 38, an end 43, and an end portion 42 with a taper 44 and a ridge 46 with proximal and distal sides 66, 67. The ridge 46 may surround the airfoil continuously or discontinuously along the pressure side, leading edge, suction side, and trailing edge. A radial spanwise dimension 40 is defined along a length of the airfoil. A chordwise dimension 41 is defined between the leading and trailing edges 32, 34, and may be considered as being parallel to a working gas containment surface 51 at the connection under consideration.

Figure 6:
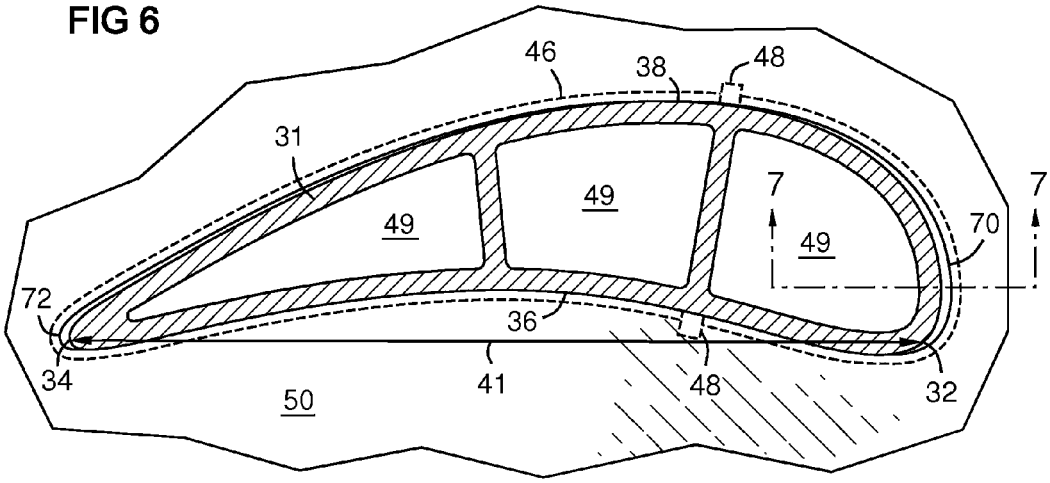
FIG. 6 shows a partial plan view of a platform with a vane in section.

A tab 48 may extend from the pressure and/or suction sides of the end portion 42 to function in cooperation with an associated vane platform to define an origin for differential expansion and contraction of the platform in the chordwise dimension. Tab 48 may be located for example at a mid-chord position or at a maximum airfoil thickness position as shown in FIG. 6. The opposite end of the airfoil 31 (not shown) may use the same connection type as the shown end portion 42 or it may use a different connection type. Cooling chambers 49 may be provided in the airfoil.

FIG. 3 is a sectional view taken along line 3-3 of FIG. 2. A bi-cast platform 50 has a working gas containment surface 51 and a collar portion 52 that holds the end portion 42 of the airfoil 31. It may have a cooling air plenum 54. The ridge 46 has a proximal side 66 that contacts a proximal side 53 of a bi-cast groove surrounding the ridge 46 in the collar 52. Clearance 55 is provided in the groove below the ridge 46 for spanwise differential expansion of the airfoil. The ridge 46 may have a top surface 47 aligned with the adjacent taper angle 44.

The taper angle 44 may vary around the airfoil to accommodate varying amounts of differential contraction of the platform 50 and collar 52 at different points around the curvature of the airfoil. The taper angle on the pressure side 36 may be less than on the suction side in order to equalize pressure on the various contact surfaces. In an exemplary engineering model, a taper angle of 3-5 degrees on the pressure side and 50% greater than the pressure side taper angle on the suction side was found to be advantageous—for example, 4 degrees on the pressure side and 6 degrees on the suction side. The optimum angles depend on the airfoil shape.

Figure 4:
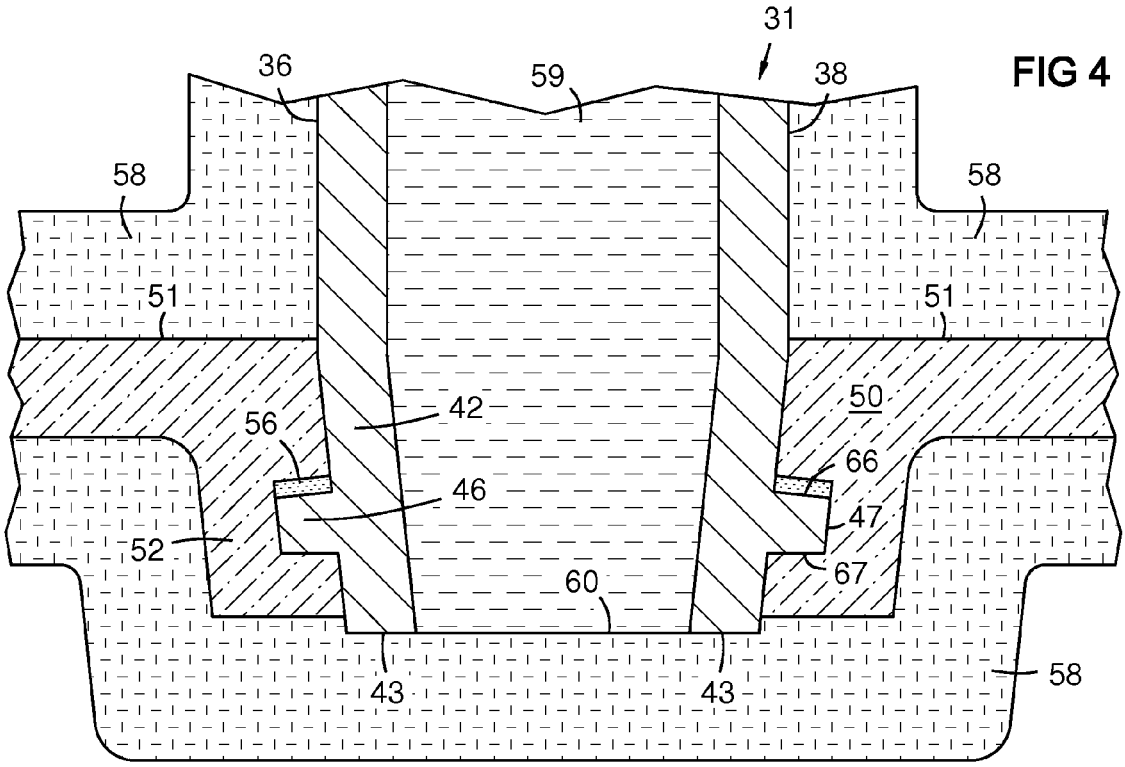
FIG. 4 is a sectional view of a stage of bi-casting of a platform on an end portion of a vane in which the platform is molten.

FIG. 4 illustrates a stage of bi-casting in a mold 58 in which the platform 50 material is molten. The mold material may encapsulate the airfoil end portion 42. The airfoil 31 may be filled with a fugitive ceramic core 59 to block the molten alloy from entering the cooling chambers. The tapered end 42 of the airfoil is placed in the mold 58. The mold may have a positioning depression 60 that fits the end 43 of the airfoil to a given depth 63 best seen in FIG. 5. For example, this depth may be equal to the clearance 55. Prior to placing the airfoil in the mold, a layer of fugitive material 56 may be applied to the proximal side 66 of the ridges 46 as shown.

Figure 5:
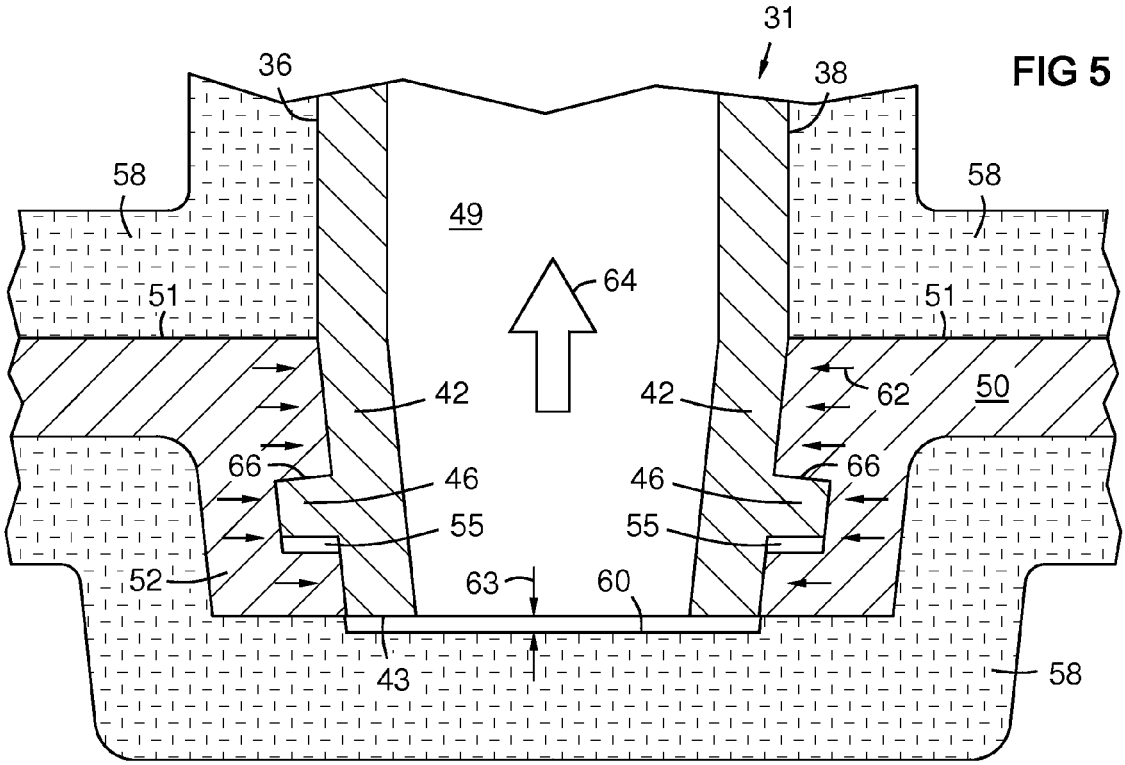
FIG. 5 is a sectional view of a stage of bi-casting in which the platform has solidified and contracted and fugitive materials have been removed.

FIG. 5 illustrates a stage of bi-casting after the platform 50 has solidified and further cooled. The platform 50 shrinks 62 as it cools. The airfoil 31 shrinks less than the platform due to a temperature differential during bi-casting. Molten metal is poured or injected into the mold 58. The airfoil stays cooler than the platform during bi-casting. Cooling from this point causes differential shrinkage that compresses 62 the collar 52 onto the tapered end portion 42 of the airfoil. This pushes 64 the airfoil upward in the drawing, or proximally with respect to the airfoil, due to the reverse wedging effect of the taper 44. The taper angle should be high enough to overcome the high contact friction between the contacting surfaces to allow sliding.

Figure 7:
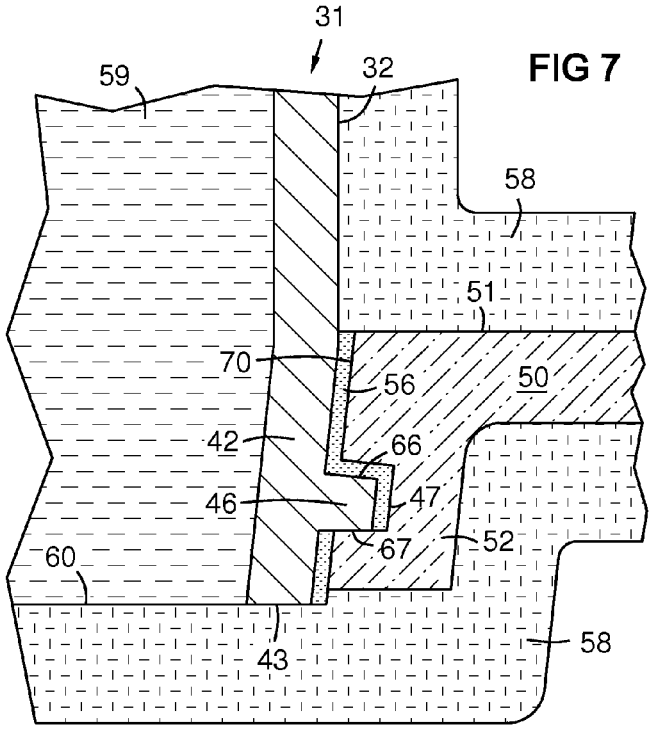
FIG. 7 shows a sectional view taken along line 7-7 of FIG. 6

FIG. 6 shows a partial plan view of a platform 50 with a vane 31 in section. Stress relief slots 70, 72 may be provided at the leading edge 32 and/or trailing edge 34 to accommodate platform contraction during casting, and airfoil expansion during operation. These slots 70, 72 may be formed with a fugitive material such as alumina or silica or aluminosilicate (mullite) coating deposited by slurry or a spray process that is chemically leached away after casting. This may be a continuation of the fugitive material 56 on the ridge 46. The leaching chemical may reach the fugitive material on the ridge 46 via the stress relief slots 70, 72. The slots 70, 72 may extend across the tapered end portion as seen in FIG. 7. They may extend in respective leading and trailing chordwise directions 41.

FIG. 7 shows a sectional view taken along line 7-7 of FIG. 6, illustrating a stage of bi-casting with fugitive material 56 on the leading edge of the tapered end portion 42 to form a leading edge stress relief slot 70. The combination of stress relief slots 70, 72, spanwise clearance gap 55, and varying taper angles 44 provides substantially uniformly distributed contact pressures in the connection over a range of operating temperatures and differential thermal expansion conditions. The connection allows a limited range of relative movement, maintains a gas seal along the contact surfaces, minimizes vibration, minimizes stress concentrations, and provides sufficient contact area and pressure for rigidity and stability of the vane ring assembly.

Figure 8:
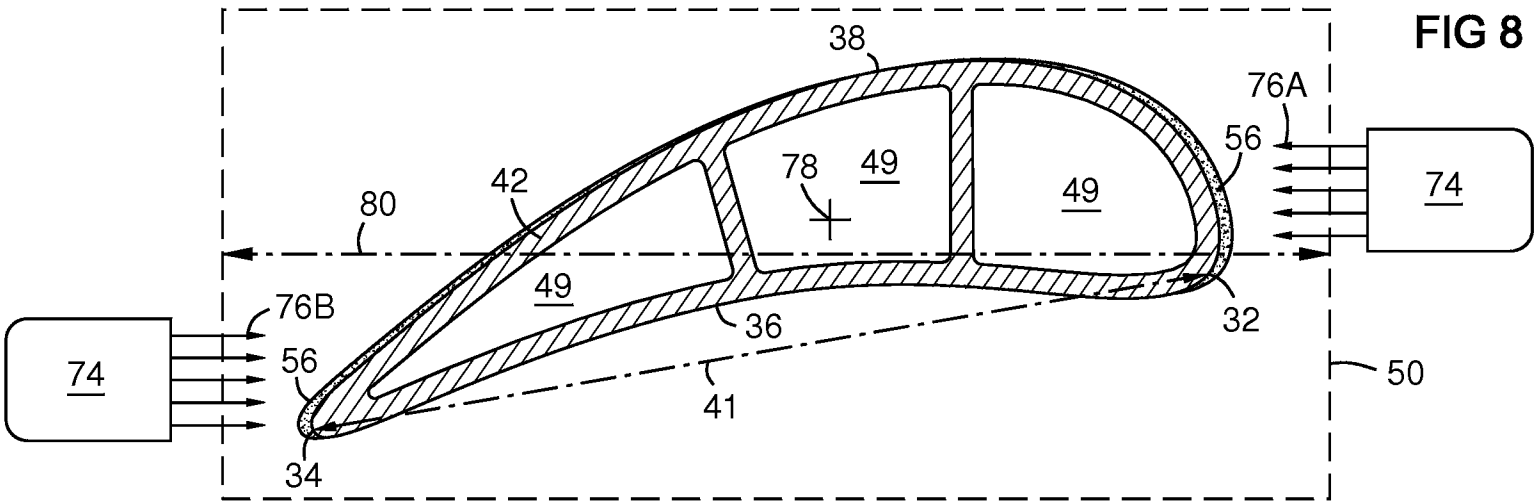
FIG. 8 shows a spray process per aspects of the invention.

FIG. 8 illustrates a process for using a selectively applied fugitive material to create a gap with controlled dimensions in order to counteract the effects of differential process shrinkage during the bi-casting of a platform onto an airfoil. Since the platform is cast around the airfoil, the platform will be cooled from a higher temperature than the airfoil, thereby causing differential shrinkage which is greatest along a longest axial length of the platform. The longest axial length is the direction of greatest shrinkage as the component cools. A process in accordance with an embodiment of the invention provides a precisely dimensioned layer of fugitive material around selected portions of the airfoil over which the platform is bi-cast. As the platform shrinks relative to the airfoil during cooling, the fugitive material may be crushed which provides space to accommodate the differential shrinkage. Furthermore, the fugitive material may be leached away during and/or after cooling, thereby reducing and controlling the residual stress in the component at a cooled temperature following the bi-cast operation.

Referring again to FIG. 8, a coating of the fugitive material 56 is applied with variable thickness on the airfoil end portion 42. The platform 50 is shown in dashed lines, since it is not present at this stage. One or more spray nozzles 74 may be moved under computer control to achieve a desired coating thickness profile. The spray 76A, 76B may be controlled to form a coating 56 that varies in thickness in proportion to distance from the geometric center 78 of the airfoil end portion 42. Alternately, the coating may be formed by directing the spray 76A, 76B parallel to a mid-platform length 80 of the platform, or parallel to the chord line 41, in respective opposite inward directions as shown. The coating may be limited to the leading edge 32, the trailing edge 34, and the suction side 38, since the pressure side 36 may receive little or no compression from differential process shrinkage, depending on the airfoil and platform geometries.

Optionally, the spray 76A, 76B may be collimated as shown, which can produce a desired coating profile with or without moving the spray nozzle(s). Collimation may be achieved by any means known in the art, and is therefore not detailed here. An example is found in U.S. Pat. No. 5,573,682.

After coating, the platform 50 is bi-cast onto the airfoil end portion 42, and then the airfoil end portion 42 and the platform 50 are cooled to a common temperature. This causes differential process shrinkage in which the platform cools from a solidification temperature that is higher than the bi-casting temperature of the airfoil end portion. The fugitive material 56 may be crushed in some embodiments as the residual stress in the component increases, thereby relieving some of the stress. Further, the fugitive material may be dissolved or otherwise removed, also relieving at least a portion of the residual stress. The thickness profile of the fugitive coating 56 is engineered and controlled during deposition so that it is effective, after removal, to provide an interface between the platform 50 and the airfoil end portion 42 with a predetermined percentage of opposed surfaces in contact, or a predetermined distribution of compressive preload at the common temperature. For example, the maximum preload may be within 130% of the minimum preload over the leading edge 32, the trailing edge 36, and the suction side 38 of the airfoil end portion 42 at a common temperature of the airfoil and platform or within a range of operating temperatures, such as 1,000 to 1,500 C.°. It will be appreciated that for a bi-cast joint between an airfoil and a shroud, it may be desired that no gap remains between the airfoil and shroud at the common temperature and operating temperatures in order to prevent the passage of a working fluid there between during use of the component in a gas turbine engine. However, some gap may be desired in order to accommodate differential shrinkage without excessive mechanical loads. Accordingly, in some embodiments the opposed adjoining surfaces of the airfoil and the shroud may be in less than 100% contact but greater than 50% in contact. While some contact and residual stress may be desired between the airfoil and the shroud, the present invention allows for that stress to be reduced and controlled to a desired value.

Figure 9:
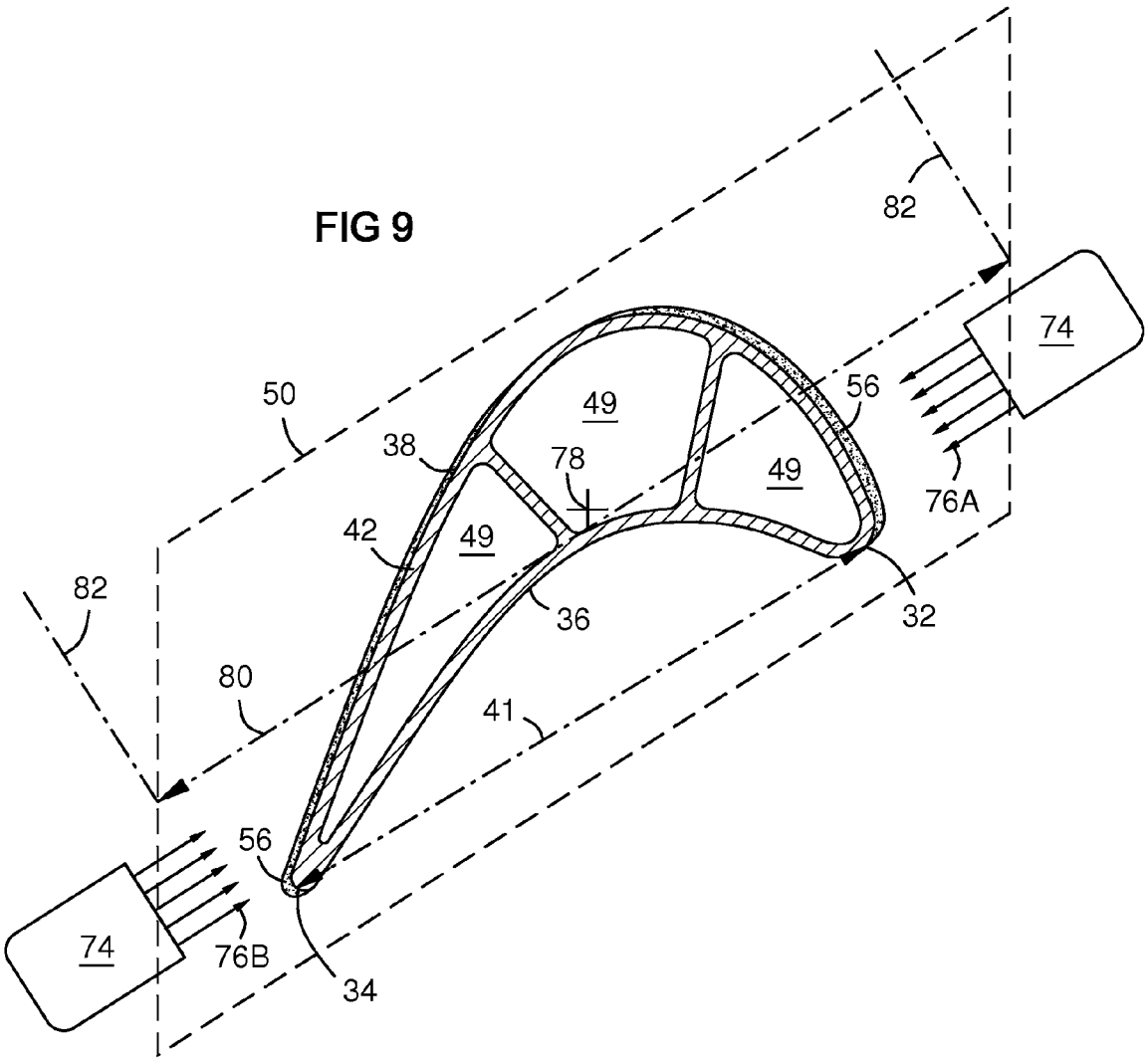
FIG. 9 shows a spray process on a highly cambered airfoil.

FIG. 9 shows an end portion 42 of a highly cambered turbine airfoil and an outline of the platform 50, illustrating another way to specify the coating thickness profile. The coating 56 may vary in thickness in proportion to proximity to a plane 82 normal to the nearest end of the mid-platform length 80. The coating may be limited to the leading edge 32, the trailing edge 34, and the suction side 38, since the pressure side 36 may receive little or no compression from differential process shrinkage, depending on the airfoil and platform geometries.

Alumina or aluminosilicate-based materials are examples of types of materials for the fugitive coating. Such materials are chemically compatible with typical metal alloy materials used for gas turbine components and thus are not harmful to the finished product even if a small amount of the fugitive material remains trapped in the airfoil/shroud joint. The spray process may be performed by known thermal spray technology such as air or low-pressure plasma spray, high velocity oxy-fuel spray, chemical vapor deposition, or physical vapor deposition, and may be controlled to a thickness of ±50 microns of a desired thickness profile in one embodiment. Porosity of the fugitive material 56 may be controlled to a desired value or range in order to facilitate crushing of the material as the component cools after bi-casting. A non-spray process such as ceramic slurry coating or molding may be alternately used. A directional spray process is preferred in some embodiments in order to form the coating thickness profile via spray direction. The resulting joint may have a mechanical interlock as described herein without a metallurgical bond.

The use of bi-casting enables less costly repair should the platform become damaged in service. The platform can be cut off, saving the high-value airfoil, and then a new replacement platform can be bi-cast onto the airfoil. Bi-casting allows parts to be designed beyond the practical limits of integral castability; improves casting yield; allows the airfoil and platform to be formed with respectively different specialized properties; and allows costly materials and processes, such as single-crystal fabrication, to be selectively used.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A method comprising:

providing a turbine airfoil comprising an end portion comprising a ridge comprising a proximal side and a distal side relative to the airfoil;

forming a fugitive coating on at least a portion of the airfoil end portion;

bi-casting a platform onto the airfoil end portion over the fugitive coating;

bringing the airfoil end portion and the platform to a common temperature, thereby causing differential shrinkage stress there between; and reducing the differential shrinkage stress by removing at least a portion of the fugitive coating;

wherein a differential process shrinkage forms a gap between the distal side of the ridge and the platform.

2. The method of claim 1, wherein the fugitive coating is formed to vary in thickness around the airfoil end portion in proportion to a variation in local differential process shrinkage between the airfoil and the platform.

3. The method of claim 1, further comprising forming a varying thickness of the fugitive coating around the airfoil end portion effective to achieve a maximum local compressive preload between the airfoil end portion and the platform to be within 130% of a minimum local compressive preload along a leading edge, a trailing edge, and a suction side of the airfoil end portion at the common temperature.

4. The method of claim 1, further comprising controlling the step of forming the fugitive coating such that after the step of removing of at least a portion of the fugitive coating, less than 100% and more than 50% of opposed surfaces of the end portion of the airfoil and the platform are in contact at the common temperature.

5. The method of claim 1, further comprising forming the fugitive coating by spraying a ceramic material onto the airfoil end portion in opposite inward directions parallel to a mid-platform length of the platform.

6. The method of claim 1, further comprising forming the fugitive coating by spraying a ceramic material onto the airfoil end portion in opposite inward directions parallel to a chord line of the airfoil.

7. The method of claim 1, further comprising varying a thickness of the fugitive coating around the end portion in proportion to a distance from a geometric center of the airfoil end portion.

8. The method of claim 1, further comprising varying a thickness of the fugitive coating in proportion to proximity to a plane normal to a nearest end of a mid-platform length of the platform.

9. The method of claim 1, further comprising limiting the fugitive coating to a leading edge, a suction side, and a trailing edge of the airfoil end portion.

10. A method comprising:

forming a turbine airfoil with an end portion at an end of the airfoil, wherein the end portion comprises:

a taper that converges toward the end of the airfoil;

a ridge with a proximal side and a distal side relative to the airfoil;

forming a coating of a fugitive ceramic material on the airfoil end portion;

limiting the coating of the fugitive ceramic material to a leading edge, a suction side, and a trailing edge of the airfoil end portion;

bi-casting a platform onto the airfoil end portion of the turbine airfoil over the coating of the fugitive ceramic material;

wherein the coating of the fugitive ceramic material varies in thickness in proportion to a variation in a differential process shrinkage between the airfoil and the platform around the airfoil end portion;

bringing the airfoil end portion and the platform to a common temperature;

removing the coating of the fugitive ceramic material;

wherein the differential process shrinkage forms a gap between the distal side of the ridge and the platform.

11. The method of claim 10, further comprising varying the thickness of the coating of the fugitive ceramic material effective to achieve a maximum preload within 130% of a minimum preload of the platform on a leading edge, a trailing edge, and a suction side of the airfoil end portion at the common temperature.

12. The method of claim 10, further comprising varying the thickness of the coating of the fugitive ceramic material effective to achieve a maximum preload within 130% of a minimum preload of the platform on a leading edge, a trailing edge, and a suction side of the airfoil end portion within a range of operating temperatures of the airfoil and platform.

13. The method of claim 10, further comprising controlling the step of forming the coating of the fugitive ceramic material such that after the step of removing the coating, less than 100% and more than 50% of opposed surfaces of the airfoil end portion and the platform are in contact at the common temperature.

14. The method of claim 10, wherein the forming of the coating of the fugitive ceramic material is by spraying a ceramic material onto the airfoil end portion in opposite inward directions parallel to a mid-platform length of the platform.

15. The method of claim 10, wherein the forming of the coating of the fugitive ceramic material is by spraying a ceramic material onto the airfoil end portion in opposite inward directions parallel to a chord line of the airfoil.

16. The method of claim 10, further comprising varying the thickness of the coating of the fugitive ceramic material in proportion to a distance from a geometric center of the airfoil end portion.

17. The method of claim 10, further comprising varying the thickness of the coating of the fugitive ceramic material in proportion to proximity to a plane normal to a nearest end of a mid-platform length of the platform.

* * * * *